US006273279B1

(12) United States Patent
Wolf

(10) Patent No.: US 6,273,279 B1
(45) Date of Patent: Aug. 14, 2001

(54) GOLF TOWEL HOLDER

(76) Inventor: Jerrold M. Wolf, 1036 E. Melody La., Fullerton, CA (US) 92831

( * ) Notice: Subject to any disclaimer, the term of this patent is extended or adjusted under 35 U.S.C. 154(b) by 0 days.

(21) Appl. No.: 09/567,382

(22) Filed: May 10, 2000

(51) Int. Cl.[7] ..... A47F 5/00

(52) U.S. Cl. ..... 211/86.01; 211/16; D8/372; 248/304; 24/372; 24/907

(58) Field of Search ..... D8/367, 371, 372, D8/373; 248/304, 305; 24/370, 372, 907; 211/86.01, 16

(56) References Cited

U.S. PATENT DOCUMENTS

D. 32,989 * 7/1900 Rousseaux .
D. 143,825 * 2/1946 Kimsey .
D. 304,545 * 11/1989 Hurrelbrink ..... D8/373
D. 322,361 * 12/1991 Goodman et al. .
D. 389,644 * 1/1998 Marziale et al. .
D. 412,250 * 7/1999 Pardue ..... D8/372 X
D. 431,451 * 10/2000 Kuo ..... D8/373
747,119 * 12/1903 Barry .
4,449,310 * 5/1984 Kline .
5,450,954 * 9/1995 Dunn .
5,647,568 * 7/1997 Nettles ..... 211/16 X
5,927,489 * 7/1999 Carswell .

* cited by examiner

*Primary Examiner*—Robert W Gibson, Jr.
(74) *Attorney, Agent, or Firm*—Allan M. Shapiro

(57) ABSTRACT

The golf towel holder has a body which carries an attachment hook by which the body is detachably attached to the top of a golf club bag. The body may include a panel which carries selected indicia thereon. The body carries two golf towel holder hooks. The first hook is a closer hook for detachably retaining a first grommeted golf towel. The second hook is more open so that it can detachably retain a second grommeted golf towel. Since the second hook is more open, the second grommeted golf towel may be more easily detached and attached. The body with its hooks may be molded of thermoplastic synthetic polymer composition material in one or more pieces or may be formed of bent wire in one or more pieces.

4 Claims, 3 Drawing Sheets

FIG. 1
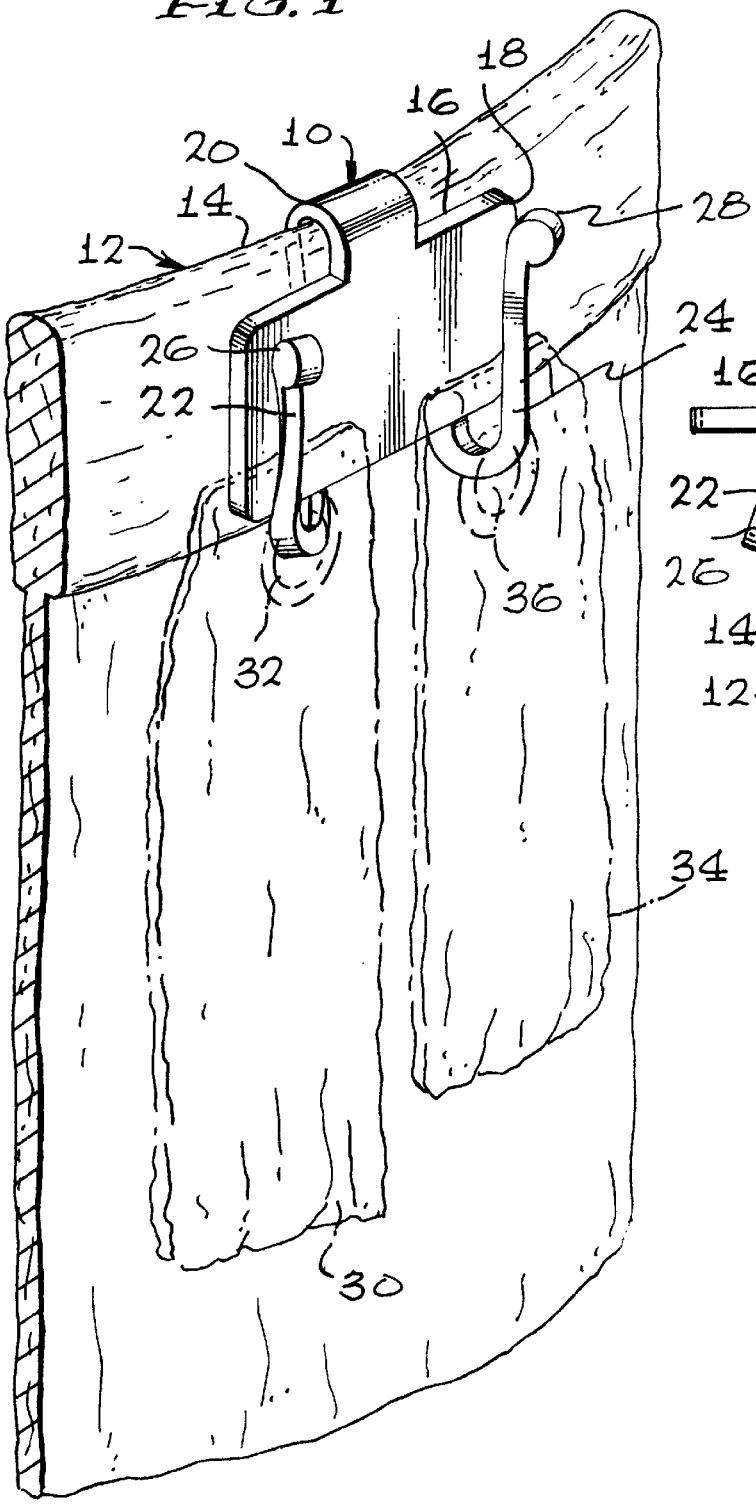
FIG. 3
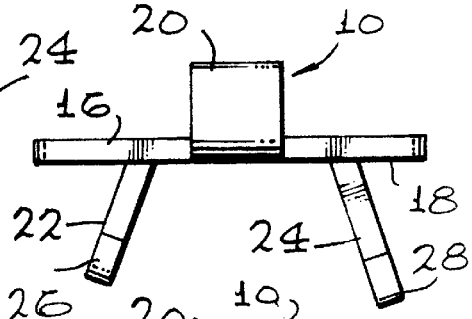
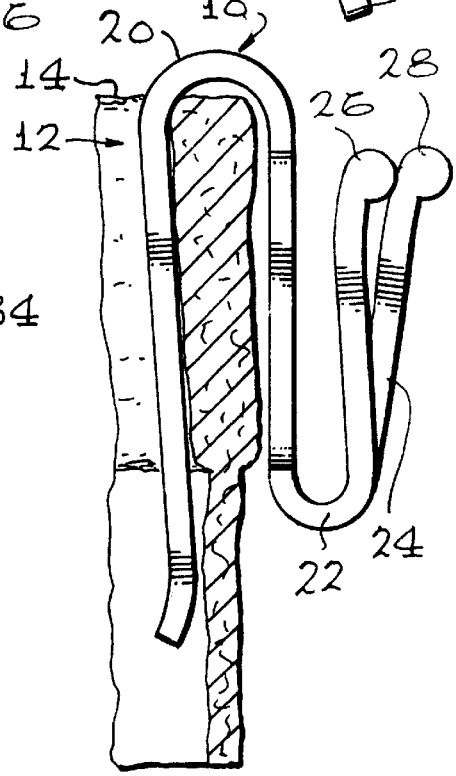
FIG. 2

FIG. 4
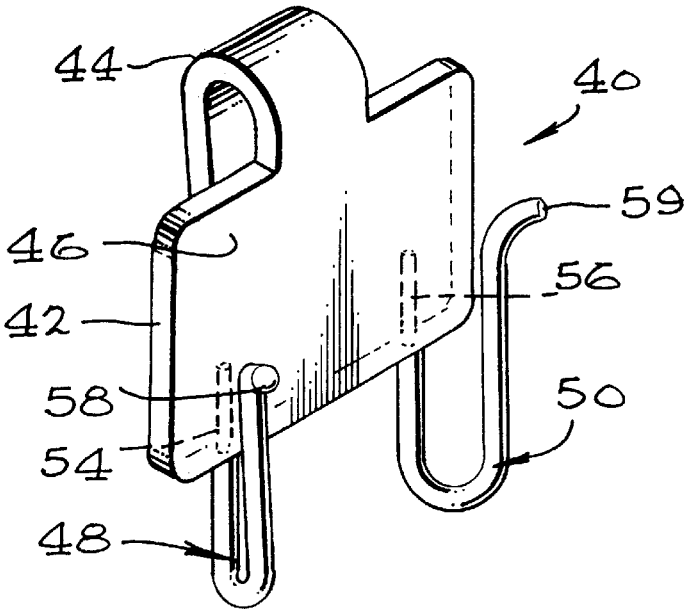
FIG. 5
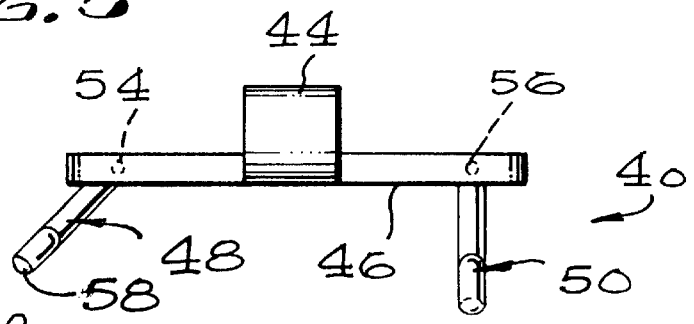
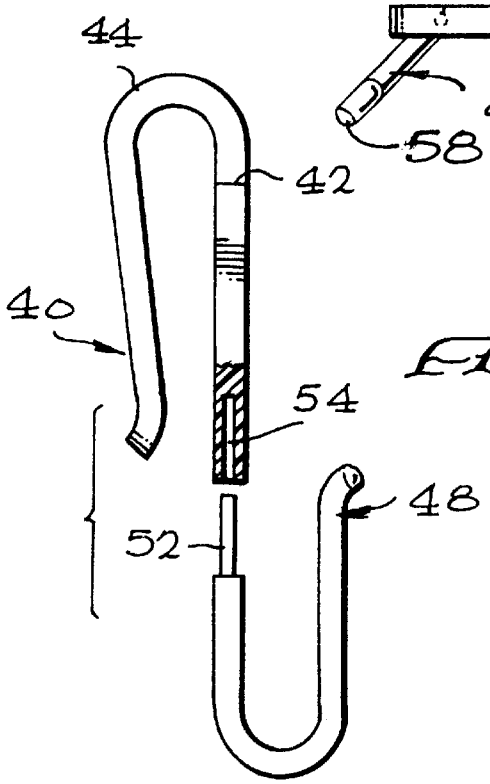
FIG. 6
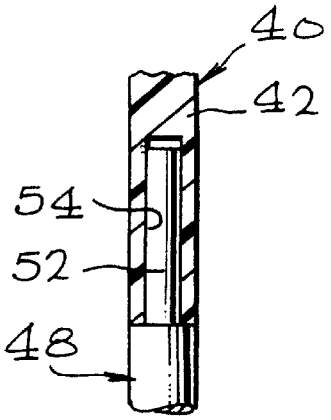
FIG. 7

FIG. 8
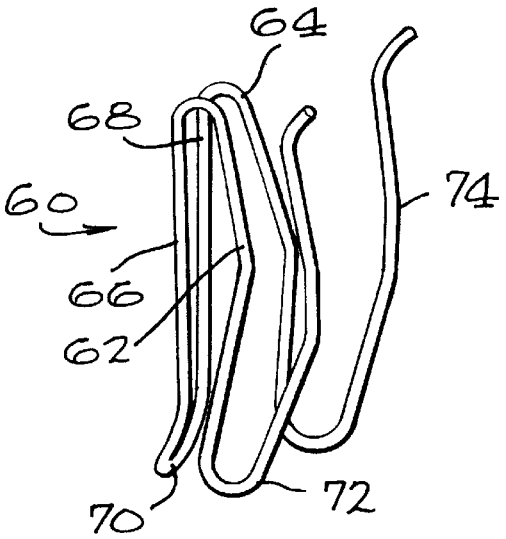
FIG. 9
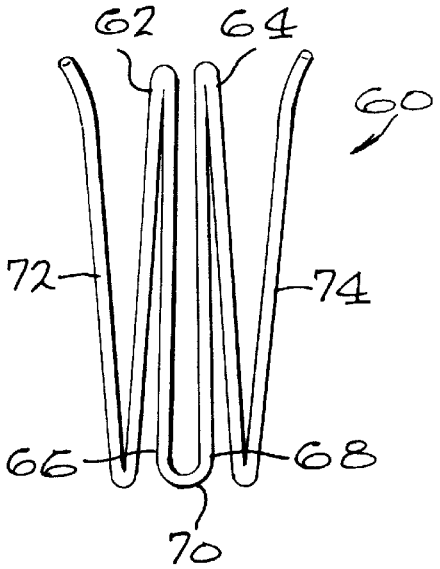
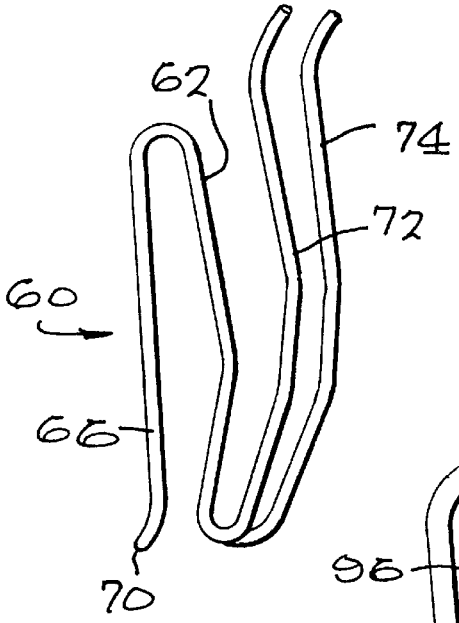
FIG. 10
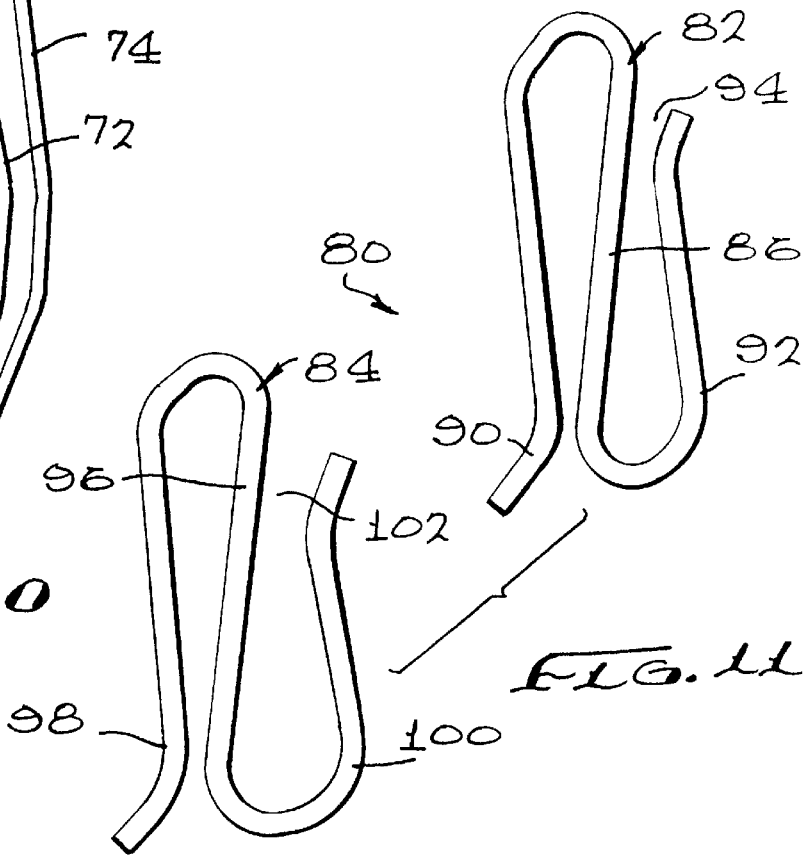
FIG. 11

GOLF TOWEL HOLDER

FIELD OF THE INVENTION

This invention is directed to a structure which engages on a golf bag and provides two hooks upon which grommeted golf towels may be hung. The two hooks are of different configuration so that the first hook is closer to more closely retain the first grommeted golf towel and the second hook is more open to aid in unhooking and hooking thereon the second grommeted golf towel.

BACKGROUND OF THE INVENTION

It is desirable in golfing to have ready access to two different golf towels. The first towel is kept dry and the second is damp. While playing golf, the damp towel is periodically used to wipe the golf ball, wipe one or more of the golf clubs and sometimes wipe the golfer's hands. The first towel is dry and is used for drying the golfer's hands. There is need for holding these towels while at the same time keeping them available for use.

SUMMARY OF THE INVENTION

In order to aid in the understanding of this invention, it can be stated in essentially summary form that it is directed to a golf towel holder having an attachment device thereon for attaching and supporting the golf towel holder on a golf club bag, for example. The golf towel holder also has first and second towel hooks thereon for being engaged respectively by grommeted first and second golf towels. The first hook is more closed so that the first towel can be hooked thereon, but is retained more closely than the second grommeted golf towel. The second grommeted golf towel is hooked on the second hook which is more open than the first hook so that the second grommeted golf towel can be more readily removed and rehooked.

It is thus a purpose and advantage of this invention to provide a golf towel holder which more closely retains a first grommeted golf towel than a second grommeted golf towel engaged thereon.

It is another purpose and advantage of this invention to provide a golf towel holder which can be hooked onto a golf club bag and detachably retain first and second grommeted golf towels thereon.

It is a further purpose and advantage of this invention to provide a golf towel holder which has a body upon which first and second golf towel hooks are mounted, with the body having a face which can carry indicia.

It is a further purpose and advantage of this invention to provide a golf towel holder which, in one preferred embodiment, can be formed of bent wire and, in another preferred embodiment, can be formed of one or more pieces of injection-molded polymer composition material.

Further purposes and advantages of this invention will be found upon the study of the following portion of the specification and the claims and drawings.

BRIEF DESCRIPTION OF THE DRAWINGS

FIG. 1 is a perspective view of the first preferred embodiment of the golf towel holder of this invention, showing it hooked over the rim of a golf club bag which is partially broken away.

FIG. 2 is an enlarged side elevational view thereof, including a portion of the golf club bag upon which it is hooked, with the golf club partially broken away.

FIG. 3 is a plan view thereof.

FIG. 4 is a perspective view of a second preferred embodiment of the golf towel holder of this invention.

FIG. 5 is a plan view thereof.

FIG. 6 is a side elevational view thereof, with parts broken away and parts taken in section, together with a hook shown in exploded position.

FIG. 7 is an enlarged fragmentary side view showing the manner in which the hook is engaged in the body, with the body taken in section through the center line of the hook.

FIG. 8 is a perspective view of another preferred embodiment of the golf towel holder of this invention, wherein it is formed of bent wire.

FIG. 9 is a front view thereof.

FIG. 10 is a side end view thereof.

FIG. 11 is an exploded side view of a further embodiment of the golf towel holder of this invention, showing a pair of individual golf towel holders, one of which has a closer hook configured to hold the first grommeted golf towel and the other of which is more open to releasably hold the second grommeted golf towel.

DESCRIPTION OF THE PREFERRED EMBODIMENTS

The first preferred embodiment of the golf towel holder of this invention is generally indicated at 10 in FIGS. 1, 2 and 3. The golf towel holder 10 is shown as associated with a golf bag 12 which is of conventional nature. The golf bag is open at the top and has a top edge 14 upon which the golf towel holder 10 is engaged. The golf towel holder 10 has a body 16 which has a substantially flat front face 18. Extending out of the top of the body is golf towel holder attachment hook 20. As is best seen in FIG. 2, the attachment hook 20 is sized to extend over the top edge 14 and hook into the interior of the golf bag 12. In this way the body 16 lies on the outside of the golf bag.

First and second hooks 22 and 24 are integrally formed with the body 16 and extend out of the bottom thereof and are then curved upwardly to define open-top hooks. The first and second hooks are very similar. The difference is that the free end 26 of the first hook 22 is spaced closer to the face 18 than the free end 28 of the second hook 24.

The first hook 22 is sufficiently open from the face 18 to permit the grommeted first golf towel 30 to be hung over the hook. The first golf towel 30 is shown in dashed lines in FIG. 1. It is shown as having a grommet 32. Similarly, the second golf towel 34 has a grommet 36 which is engaged over the second hook 24. Since the hook 24 is spaced further from the face 18, it is easier to engage a grommeted golf towel on and remove it from the second hook 24. The grommeted dry towel or first towel 30 has its grommet 32 engaged over the first hook 22 and it is normally left in that position for the duration of the golf game. The grommeted second golf towel 34 is wet or damp. At the beginning of the game it has its grommet 36 engaged over the second hook 24.

In the course of the game, the second towel 34 is periodically unhooked and is used to wipe the ball, wipe the clubs or wipe the hands of the golfer. When this wiping is done, it is re-engaged with its grommet 36 over the second hook 24. Thereupon, the golfer dries his hands on the first towel 30. During the course of a golf game, the second towel 34 may be removed and replaced a plurality of times, while the first towel or dry towel 30 is not removed until the end of the game for washing or replacement. The golf towel holder 10 thus provides a first hook 22 over which the grommeted first or dry towel 30 is engaged for the course of the game. It also provides a second hook 24 which is more open so that the second or damp towel 34 can have its grommet 36 readily engaged and disengaged from the hook. The differences in the two hooks, with the second hook being more open or accessible, is to provide easy removal and reattachment of the second towel.

The face 18 has additional utility. It may carry indicia identifying the owner, identifying the golf organization or identifying a product used in golfing. The golf towel holder 10 is preferably made of one piece of injection moldable thermoplastic synthetic polymer composition material.

The second preferred embodiment of the golf towel holder of this invention is generally indicated at 40 in FIGS. 4, 5 and 6. The golf towel holder 40 has a body 42 in the form of a generally rectangular panel. It has an attachment hook 44 attached thereon and formed of unitary construction with the body 42. The attachment hook is open downwardly in the same manner as the attachment hook 20. Attachment hook 44 is also configured and sized to be able to engage over the top edge of the golf bag, as seen for the hook 20 in FIG. 1. The body 42 has a front face 46 which can carry indicia thereon, such as the name of the golf club, the name of the manufacturer of golf equipment or the sponsor of a golf tournament, or the like. The body 42 and attachment hook 44 are preferably integrally formed, such as by injection molding of thermoplastic synthetic polymer composition material.

First and second towel hooks 48 and 50 are of the same construction. They may be made of wire, and in which case they are preferably coated for a substantial part of the length, but leaving a neck 52 of exposed wire. On the other hand, they may be injection molded of the same or similar thermoplastic synthetic polymer composition material as the body. When molded, the same smaller diameter neck 52 is provided. The body 42 has first and second holes in the bottom thereof. The first hole 54 is seen in FIGS. 6 and 7. The holes are sized to receive the neck 52. The second hole 56 is shown in dashed lines in FIGS. 4 and 5. The second towel hook 50 has the same kind of neck thereon which engages in the second hole 56. Both of the first and second towel hooks 48 and 50 are the same. They are upwardly open hooks with forwardly extending tips 58 and 59 which aid in engagement of the grommet of a golf towel.

In accordance with the teaching described with respect to the golf towel holder 10, the opening of hook 48 is smaller than the opening of hook 50. Rather than configuring the hooks in a different way, they are placed in the body 46 at different angles so that the second hook 56 has a larger opening between the open end of its U-shape and the face 46 of the body 42. This is accomplished by setting them at different angles with respect to the face 46. When the second hook 50 is positioned at a right angle to the face 46, the opening is maximized. Since the first hook 48 is an acute angle with respect to the face 46, it has a smaller opening between the free end of its hook and the face 46. Thus, the grommeted first towel is engaged on the first hook 48, and is more securely attached than the grommeted second towel engaged on the second hook 50 because the first hook 48 is tighter than the second hook 50.

A further preferred embodiment of the golf towel holder of this invention is shown in FIGS. 8, 9 and 10 where it is generally indicated at 60. The golf towel holder 60 is formed of a single piece of bent wire. The bent wire is preferably resilient, such as somewhat hardened medium carbon steel wire, and plastic coated. The portion corresponding to the body of the previously described embodiments of the golf towel holder are the downwardly extending legs 62 and 64. These two legs together form the body of this golf towel holder. The two body legs are joined by attachment hook legs 66 and 68. The attachment hook legs are joined together by loop 70. As seen in FIGS. 8 and 10, the lower end of the legs and the loop 70 are bent backward to form an opening to aid in engaging the golf towel holder 60 over the top edge of a golf club bag, similarly to the manner shown in FIG. 1. The attachment hook legs extend in to engage on the interior of the golf bag. The curved top loop transitions between the attachment hook legs and their corresponding body legs are sufficiently large loops to comfortably fit over the top edge 14 of the golf club bag.

At the bottom of the body legs, there is a forward curve to the upwardly directed first and second towel hooks 72 and 74. As is best seen in FIG. 10, the first towel hook 72 lies closer to the body leg 62 than the second towel hook 74 lies to the body leg 64. Thus, the first towel hook 72 more firmly retains the grommeted first towel engaged thereon, as compared to the more loose hook 74 which permits the grommeted second towel to be more readily attached and detached in the same manner as in the previously described embodiments.

The golf towel holder 80 illustrated in FIG. 11 is another preferred embodiment of the golf towel holder of this invention. The golf towel holder 80, rather than comprising a one-piece device is comprised of the first towel hook 82 and the second towel hook 84. The first and second towel hooks 82 and 84 are formed of bent wire, such as the wire described with respect to the golf towel holder 60. The first towel hook 82 has a body leg 86 which has at its top a curve wherein the wire extends downward as an attachment hook leg 88. The upper loop connection between the body leg and the attachment hook leg 88 is sufficient to permit attachment over the top edge of the golf club bag, as previously described. The lower end of the attachment hook leg has an outwardly directed tip 90 which aids in proper engagement over the top edge of the golf club bag. The body leg 86 loops upward at its bottom to form towel hook 92. The towel hook 92, at its upper end, is outwardly directed to aid in the engagement of a grommeted towel over the towel hook. However, the opening 94 between the upper end of the towel hook 92 and the body leg 86 is fairly close so that the first grommeted towel may be installed thereon but is not easily installed and removed.

The other half of the golf towel holder 80 is second towel hook 84. It has a body leg 96 which, at its top, loops downward to become attachment hook leg 98. This is also configured to engage over the top edge of the golf bag. The lower end of body leg 96 is looped upward to form towel hook 100. The hook 100 is configured to be more open than hook 92. The opening 102 between the body leg 96 and the top of towel hook 100 is larger than the opening 94 between body leg 86 and towel hook 92. Thus, the second towel hook 84 can carry the damp grommeted second towel which can be engaged upon and readily removed from the second towel hook 84.

In each of these cases the first towel hook permits the attachment of a first or dry grommeted towel with relative permanence and the engagement of the second or damp grommeted towel on the second towel hook with comparative ease for removal and reattachment.

This invention has been described in its contemplated best embodiments, and it is clear that it is susceptible to numerous modifications, modes and embodiments within the ability of those skilled in the art and without the exercise of the inventive faculty. Accordingly, the scope of the present invention is defined by the scope of the following claims.

What is claimed is:

1. A golf towel holder comprising:

a body;

attachment structure on said body for releasably mounting said body on a golf club bag or the like;

first and second golf towel holders comprising respective first and second towel hooks, said first and second golf towel holders being formed separately from said body and separately attached to said body, said first towel hook being closer to said body than said second towel hook so that said first towel hook more firmly retains a golf towel thereon than said second golf towel hook retains a golf towel thereon.

2. The golf towel holder of claim 1 wherein said first and second towel hooks are of the same configuration and are differently mounted on said body so that the hook of said first towel holder is closer to said body than the hook of said second towel holder.

3. The golf towel holder of claim 2 wherein said attachment structure on said body comprises a downwardly open attachment hook on said body, said attachment hook being sized and shaped to engage over the top edge of a golf bag.

4. The golf towel holder of claim 3 wherein said body and said attachment hook are integrally formed.

* * * * *